US006298497B1

(12) United States Patent
Chartrand

(10) Patent No.: US 6,298,497 B1
(45) Date of Patent: Oct. 9, 2001

(54) HOCKEY HELMET WITH SELF-ADJUSTING PADDING

(75) Inventor: Daniel Chartrand, Deux-Montagnes (CA)

(73) Assignee: Bauer Nike Hockey, Inc., Montreal (CA)

( * ) Notice: Subject to any disclaimer, the term of this patent is extended or adjusted under 35 U.S.C. 154(b) by 0 days.

(21) Appl. No.: 09/309,000

(22) PCT Filed: Nov. 26, 1997

(86) PCT No.: PCT/CA97/00905

§ 371 Date: Jul. 30, 1999

§ 102(e) Date: Jul. 30, 1999

(87) PCT Pub. No.: WO98/23174

PCT Pub. Date: Jun. 4, 1998

(30) Foreign Application Priority Data

Nov. 29, 1996 (CA) ..... 2191678
Nov. 29, 1996 (CA) ..... 2191694

(51) Int. Cl.[7] ..... A42B 3/12
(52) U.S. Cl. ..... 2/414; 2/417; 2/425
(58) Field of Search ..... 2/410, 411, 412, 2/414, 417, 418, 419, 420, 425

(56) References Cited

U.S. PATENT DOCUMENTS 3,579,637 5/1971 Aileo .
3,820,163 6/1974 Rappleyea .
4,282,610 8/1981 Steigerwald et al. .
4,404,690 9/1983 Farquharson .
4,827,537 * 5/1989 Villa ..... 2/410
5,272,773 * 12/1993 Kamata ..... 2/421
5,511,250 4/1996 Field et al. .
5,628,071 * 5/1997 Nezer ..... 2/410

FOREIGN PATENT DOCUMENTS 3821513 10/1989 (DE) .
4421094 12/1995 (DE) .
0 346 608 12/1989 (EP) .
0 391 389 10/1990 (EP) .
7-109609 4/1995 (JP) .

* cited by examiner

*Primary Examiner*—Michael A. Neas
(74) *Attorney, Agent, or Firm*—Ratner & Prestia

(57) ABSTRACT

A pad assembly for use in a protective helmet shell. The pad assembly is formed from a resilient material. The pad assembly includes a front pad assembly, a back pad assembly, and an intermediate pad assembly. The front pad assembly is attached to a front portion of the helmet shell, the back pad assembly is attached to a back portion of the helmet shell, and the intermediate pad assembly is both centrally located between the front pad assembly and the back pad assembly and slidably connected to the front pad assembly and to the back pad assembly.

23 Claims, 6 Drawing Sheets

HOCKEY HELMET WITH SELF-ADJUSTING PADDING

FIELD OF THE INVENTION

The present invention is directed to a protective helmet suitable for use in sporting activities such as hockey, and more particularly to a novel padding structure for use in hockey helmets.

BACKGROUND OF THE INVENTION

The use of protective headgear in various types of sports or hazardous activities is well known. Conventional protective helmets have one or more inner pads secured by fasteners to the inner surfaces of a rigid helmet shell and are generally adapted to conform to the shape of a wearer's head. A principal concern is the ability of a protective helmet to absorb specific forces. In the case of hockey helmets, these standards have been set forth by the Canadian Standards Association, in their Standards for Hockey Helmets, under publication No. Z262.1-1975, and are generally internationally accepted. For instance, corresponding H.E.C.C, C.E.N. and I.S.O. standards have been established.

One of the problems associated with the use of such helmets arises when the inner pads of the helmet are not properly fitted to the head of the user. Since human heads vary widely in size and shape, these variances create significant difficulties in designing hockey helmets which are required to fit tightly on the head of the wearer to provide the desired level of protection. This problem is further exacerbated when high density foam materials are used to form the padding due to the inherent non-compliant nature of these materials. However the use of high density foam padding material is advantageous due to its ability to absorb significant levels of energy. There is therefore a need for an improved hockey helmet which utilizes high density padding but which is comfortable to the wearer.

SUMMARY OF THE INVENTION

It is an object of the present invention to provide a protective helmet which achieves enhanced fit to the head of a wearer of the helmet.

It is another object of the present invention to provide a protective helmet which enhances the comfort potential of the helmet.

It is a further object of the present invention to provide a protective helmet in which the liner may vary in densities.

It is yet a further object to provide a hockey helmet having proper ventilation features.

In accordance with the present invention, there has been provided a pad assembly for use in a protective helmet shell, said pad assembly being formed from a shock absorbing material and comprising a front pad assembly, a back pad assembly and an intermediate pad assembly centrally positionable between said front pad assembly and said back pad assembly, and wherein said intermediate pad is slidably connectable to said front pad assembly and to said back pad assembly.

Also provided in accordance with this invention is a protective helmet comprising an outer rigid helmet shell shaped to protect top, rear, front and sides regions of a wearer's head and a pad assembly, said pad assembly being formed from a shock absorbing material and comprising a front pad assembly, a back pad assembly and an intermediate pad assembly centrally positionable between said front pad assembly and said back pad assembly, and wherein said intermediate pad is slidably connectable to said front pad assembly and to said back pad assembly.

Also provided in accordance with this invention is a novel pad assembly adapted for use as an inner surface of a helmet shell, the pad assembly including a front pad assembly, a back pad assembly and an intermediate pad assembly, each of said pad front assemblies and said back pad assemblies having respective integrally formed fasteners, and said intermediate pad assembly being substantially free of any fasteners and being retained within the helmet shell by means of a slidable attachment means to secure the intermediate pad assembly to both the front and back pad assemblies and thereby slidably retain said intermediate pad assembly within said helmet shell.

DESCRIPTION OF THE PREFERRED EMBODIMENTS

Figure 1:
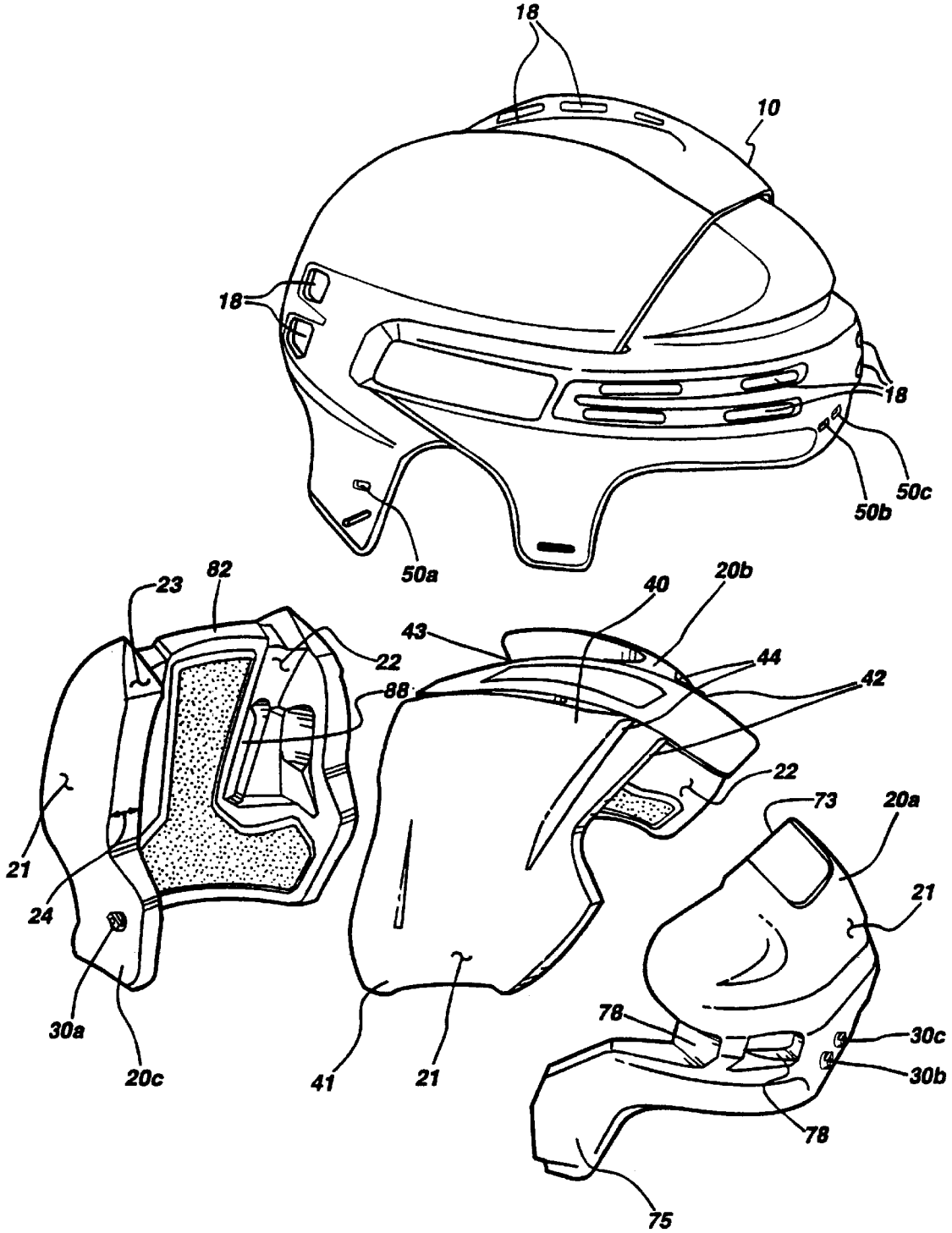
FIG. 1 is an exploded perspective view of the protective helmet of the present invention illustrating the helmet shell and pad assemblies.
Figure 2:
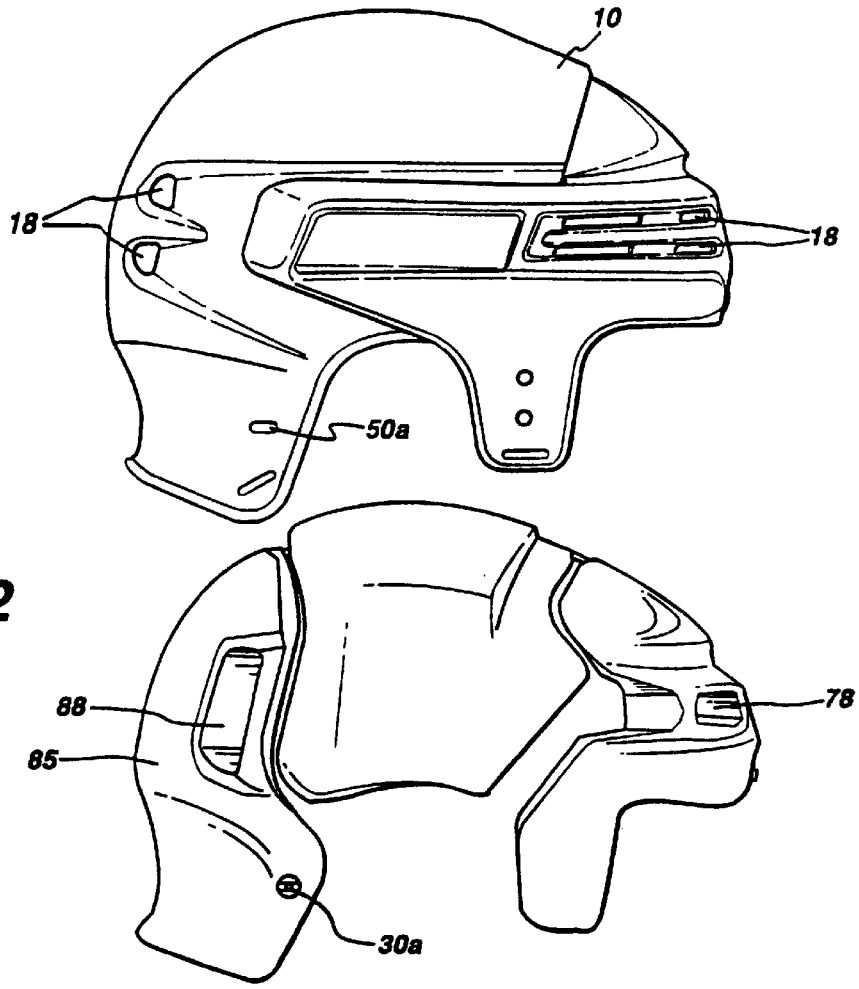
FIG. 2 is a side view of the protective helmet of the present invention illustrating the helmet shell and pad assemblies.

Referring to FIGS. 1 and 2, there is shown a protective helmet comprising an outer helmet shell 10 which is preferably made of a relatively rigid material, such as a polycarbonate alloy, a rigid thermoplastic, or a thermosetting resin. The helmet shell 10 is provided with a plurality of mounting holes 50*a*, 50*b* and 50*c*, each one having a shape which substantially conforms to a fastener, as hereinafter described, which is inserted into the mounting hole and releasably secured therein by securement means, not shown. The helmet shell 10 may also be provided with a plurality of ventilation apertures 18 located along a front portion and a rear portion of the helmet shell 10.

The protective helmet further comprises an inner pad assembly which includes a front pad assembly 20*a*, an intermediate pad assembly 20*b* and a back pad assembly 20*c*. The inner pad assembly is positioned within the helmet shell 10 to dissipate forces applied against the helmet shell 10 thereby protecting a wearer's head from the applied forces. It is preferred that the front pad assembly 20*a*, the intermediate pad assembly 20*b* and the back pad assembly 20*c* cover substantially the entire inner surface of the helmet shell 10.

Referring to FIGS. 1–7, it is seen that the front pad assembly 20*a*, the intermediate pad assembly 20*b* and the back pad assembly 20*c* comprise the following general characteristics. Each pad assembly 20*a*, 20*b* and 20*c*, respectively have a back surface 21 defining a helmet shell contacting surface, a front surface 22 defining a wearer contacting surface, and side surfaces 23 connecting said back and front surfaces and defining a thickness 24 of each respective pad assembly. The front pad assembly 20*a* is generally rearwardly curved, so that it is adapted to generally accommodate at least the forehead portion of the wearer. The front pad assembly 20*a* also includes a pair of downwardly extending legs 75 which serve to protect the temple area. The intermediate pad assembly 20*b* is generally adapted to accommodate the upper portion of the human head as well as the left and right sides of the human head. The intermediate pad assembly has a top portion 40 which is generally downwardly concave and bottom portion 41 which is preferably adapted to accommodate a wearer's ear on each side. Intermediate pad assembly 20*b* may optionally taper slightly towards a front portion 42 to form a front recessed area 44 and towards a rear portion 43 to form a rear recessed area not shown. Front portion 42 and rear portion 43 of intermediate pad assembly 20*b* are adapted to substantially conform to the rear portion 73 of front pad assembly 20*c* and front portion 82 of back pad assembly 20*a*, respectively. The back pad assembly 20*c* has an upper portion 80 and a forward portion 83 at each side thereof, and there is a further ventilation aperture 88 formed in a back side 85 thereof. The purpose and location of the ventilation apertures is discussed below in more details.

As is well known, it is important to provide free space within the interior of a protective helmet to permit evaporation of perspiration. As illustrated in FIGS. 1–4 and 6, each pad assembly is provided with one or more ventilation apertures 78 and 88 or ventilation channels 48 which are generally aligned with the ventilation apertures 18 in the helmet shell 10 to permit airflow in and out of the protective helmet, to promote cooling and to carry off warm moist air from within the protective helmet to the outside. Accordingly, the front pad assembly 20*a* is provided with ventilation apertures 78, the back pad assembly 20*c* is provided with ventilation apertures 88, and the intermediate pad assembly 20*b* is provided with ventilation channels 48. It is preferred that the ventilation apertures 78 in the front pad assembly 20*a*, the ventilation channels 48 in the intermediate pad assembly 20*b* and the ventilation apertures 88 in the back pad assembly 20*c* be substantially aligned longitudinally, i.e. from a front portion of said protective helmet, beginning at ventilation apertures 18 adjacent a front portion of the helmet shell 10 continuing through each respective pad assembly, and terminating at the ventilation apertures 18 adjacent a back portion of the helmet shell 10, to promote the movement of air through the helmet with movement of the wearer.

Figure 5:
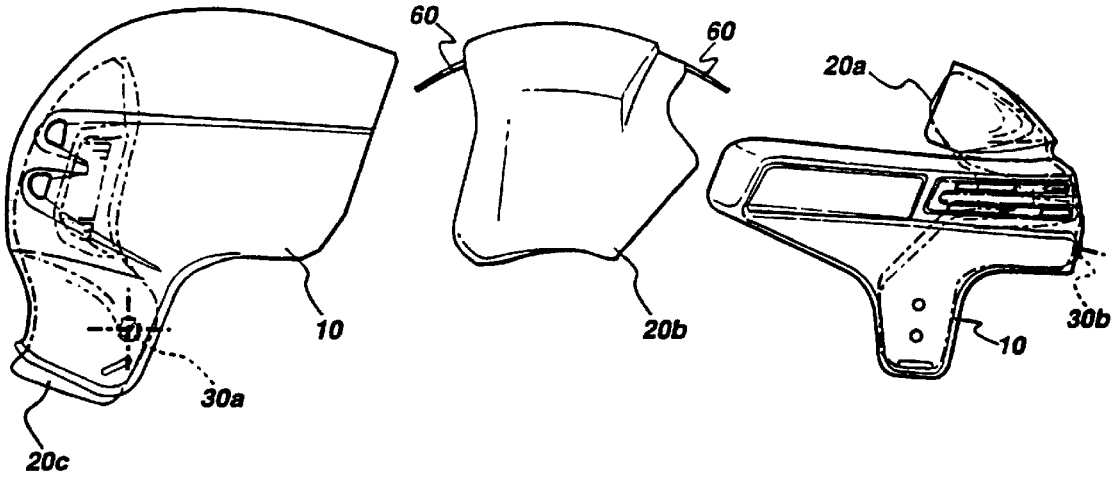
FIG. 5 is a fragmentary sectional view of the main pad assemblies of the present invention.

As shown in FIG. 5, only two of the pad assemblies 20*a* and 20*c* are attached to helmet shell 10.

Referring to FIGS. 2–5, the front pad assembly 20*a* and the back pad assembly 20*c* further comprise fasteners 30*b* and 30*c* which are embedded into the front pad assembly 20*a*, and fastener 30*a* which is embedded into back pad assembly 20*c*. The fasteners preferably extend outward and protrude from the surface of each respective pad assembly and is adapted to conform to the mounting holes 50*a*, 50*b* and 50*c* in helmet shell 10. Back pad assembly 20*c* is similarly attached or affixed to an opposite side of helmet shell 10 which is not shown in the figures. It is preferred that the securement means be releasable to permit removal of the inner pad assemblies.

Securement means (not shown) may be utilized to retain the fasteners 30*a*, 30*b* and 30*c* to the helmet shell 10 and may comprise any conventional releasable fastener such as threaded screws, bolts, rib fasteners, spring clips, and the like. It is preferred that the securement means comprises a threaded screw. While the fastener and securement means can be constructed from suitable materials such as metals, nylon-type materials, plastics, and the like, it is preferred that the fastener and securement means be constructed of plastics or nylon-type materials to provide added protection to a wearer of the helmet.

Figure 6:
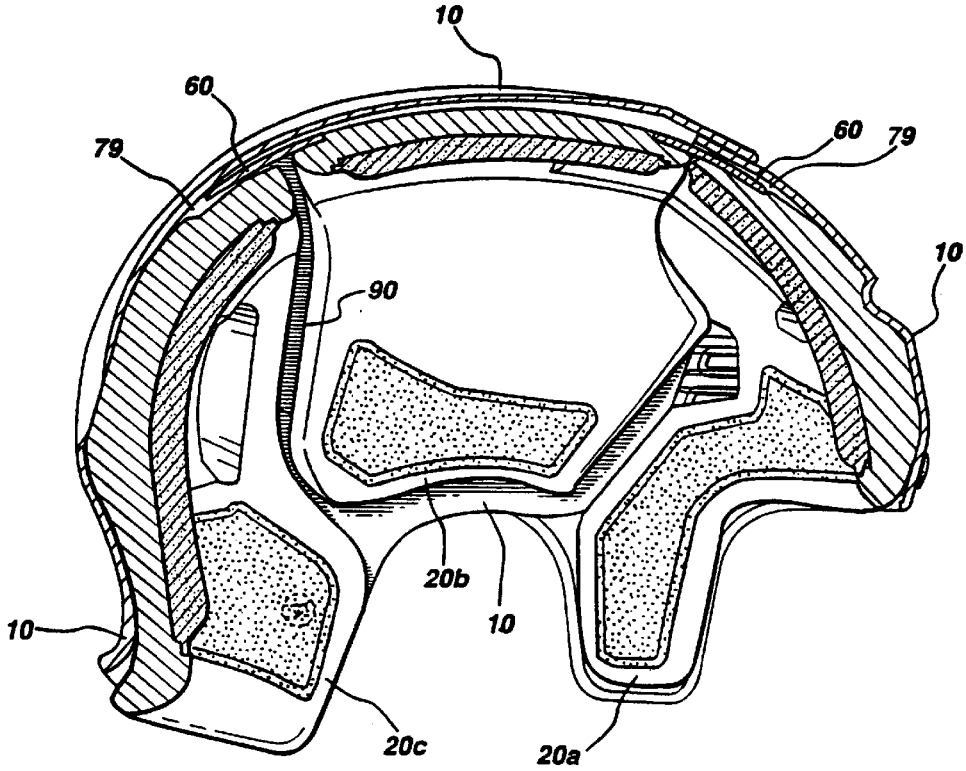
FIG. 6 is a sectional view of the helmet of the present invention illustrating the interconnection of the intermediate pad with both the front and back pads taken along line 6—6 of FIG. 4.

As shown in FIGS. 5 and 6, in use, the fastener 30*b* is inserted into a mating mounting hole 50*b* formed in the helmet shell 10 and secured with securement means (not shown). In this manner, when the securement means is engaged in the fastener, the front pad assembly 20*a* is securely attached to the helmet shell 10.

Intermediate pad 20*b* is centrally located between said front pad assembly 20*a* and said back pad assembly 20*c* and is slidably connected to said front pad assembly 20*a* and to said back pad assembly 20*c*. As used herein, the terminology "slidably connected" refers to a connection means which permits said intermediate pad assembly 20*b* to slide from a first position wherein said intermediate pad assembly is more closely associated with front pad assembly 20*a*, to a second position wherein said intermediate pad assembly 20*b* is more closely associated with back pad assembly 20*c*. In accordance with this aspect of the invention, front pad assembly 20*a* and back pad assembly 20*c* are generally separated from each other by a distance which is greater than a longitudinal dimension of intermediate pad assembly 20*b* so as to permit movement of intermediate pad assembly 20*b* from said first position to said second position. As illustrated in FIG. 6, when intermediate pad assembly 20*b* is inserted between front pad assembly 20*a* and back pad assembly 20*c*, there is a gap 90 shown for illustrative purposes as being between the intermediate pad assembly 20*b* and back pad assembly 20*c*. It is of course understood that, as intermediate pad assembly slides from a front position as illustrated in FIG. 6 to a rear position (not shown), the gap 90 will be similarly formed between the intermediate pad assembly 20*b* and the front pad assembly 20*a*.

Figure 3:
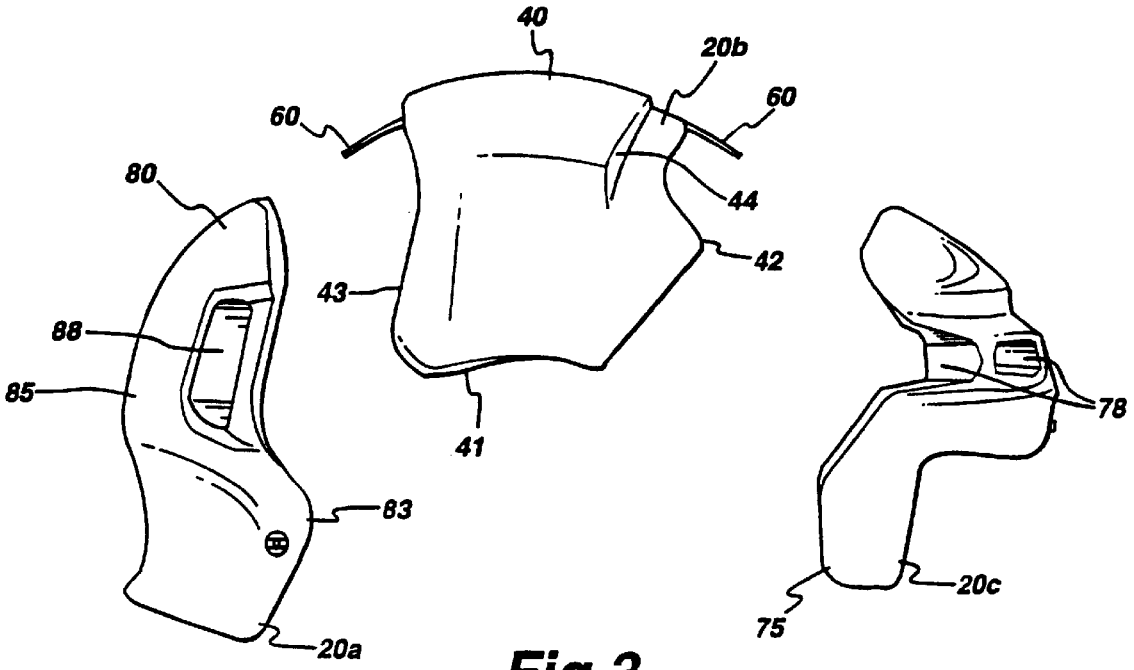
FIG. 3 is an exploded side view of the pad assemblies of the present invention.
Figure 4:
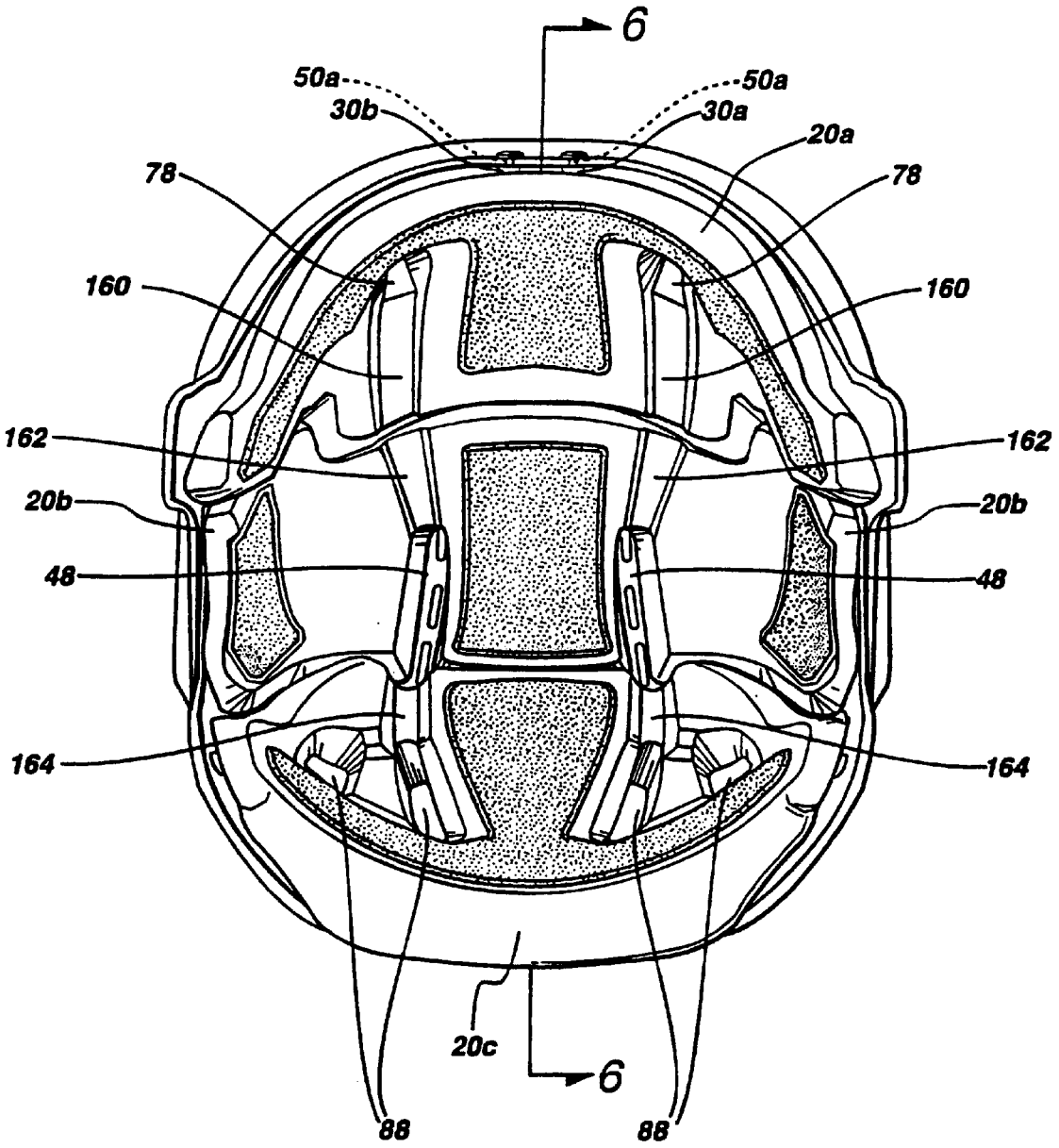
FIG. 4 is a bottom view of the hockey helmet of the present invention illustrating the interconnection of the pad assemblies in the helmet shell.

Alternatively, as illustrated in FIGS. 1 and 3, intermediate pad assembly 20*b* may optionally be tapered along front portion 42 and/or rear portion 43 to create recessed areas 44. Recessed areas 44 are sufficiently tapered so as to permit an overlap between intermediate pad assembly 20*b* and either front pad assembly 20*a* or back pad assembly 20*c*, or both. Accordingly, rather than a gap being formed between the respective pad assemblies, the intermediate pad assembly may be slidably moved from a front position to a rear position along the length of the tapered recessed areas 44.

Figure 7:
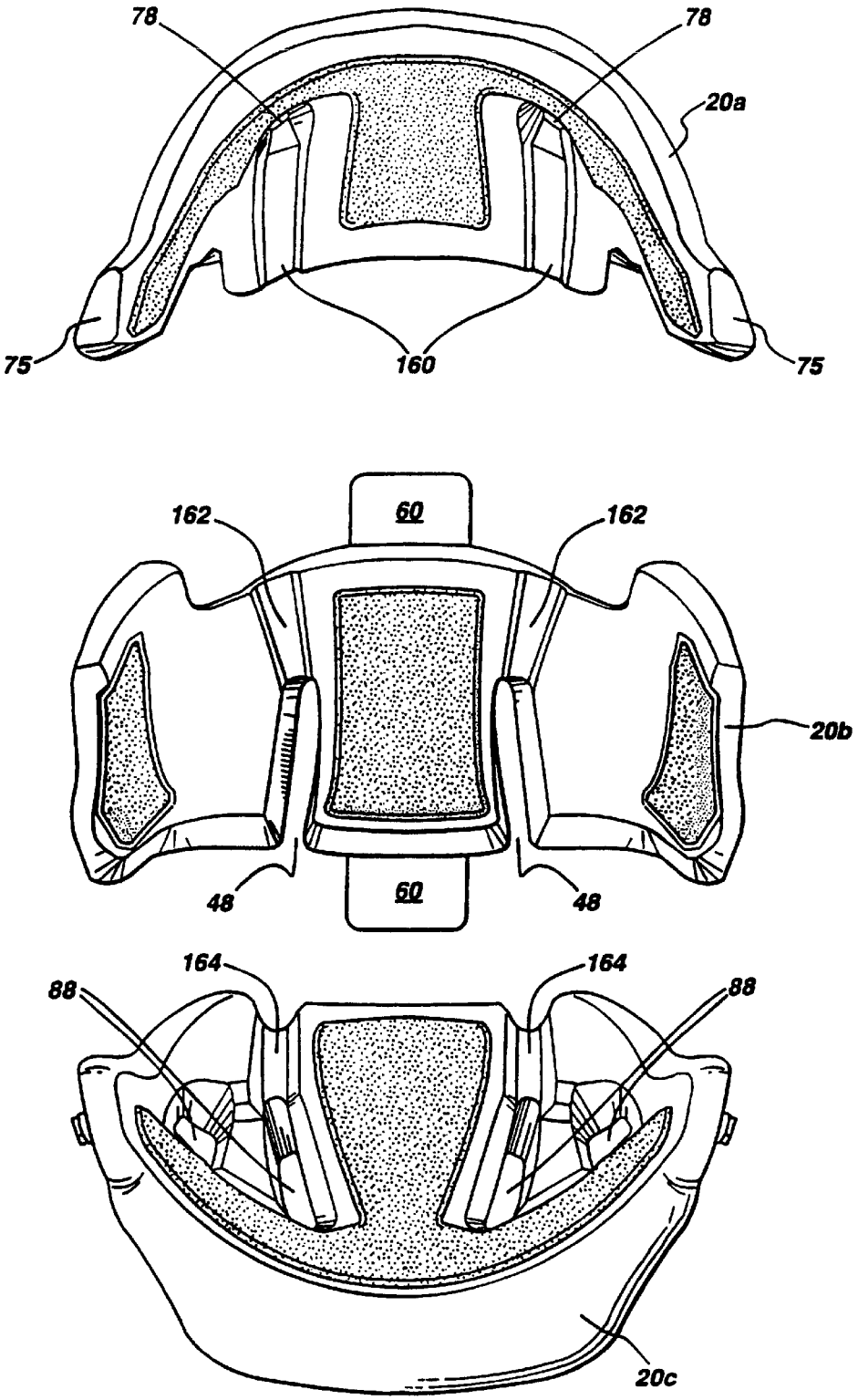
FIG. 7 is an exploded bottom view of the pad assemblies of the present invention.
Figure 8:
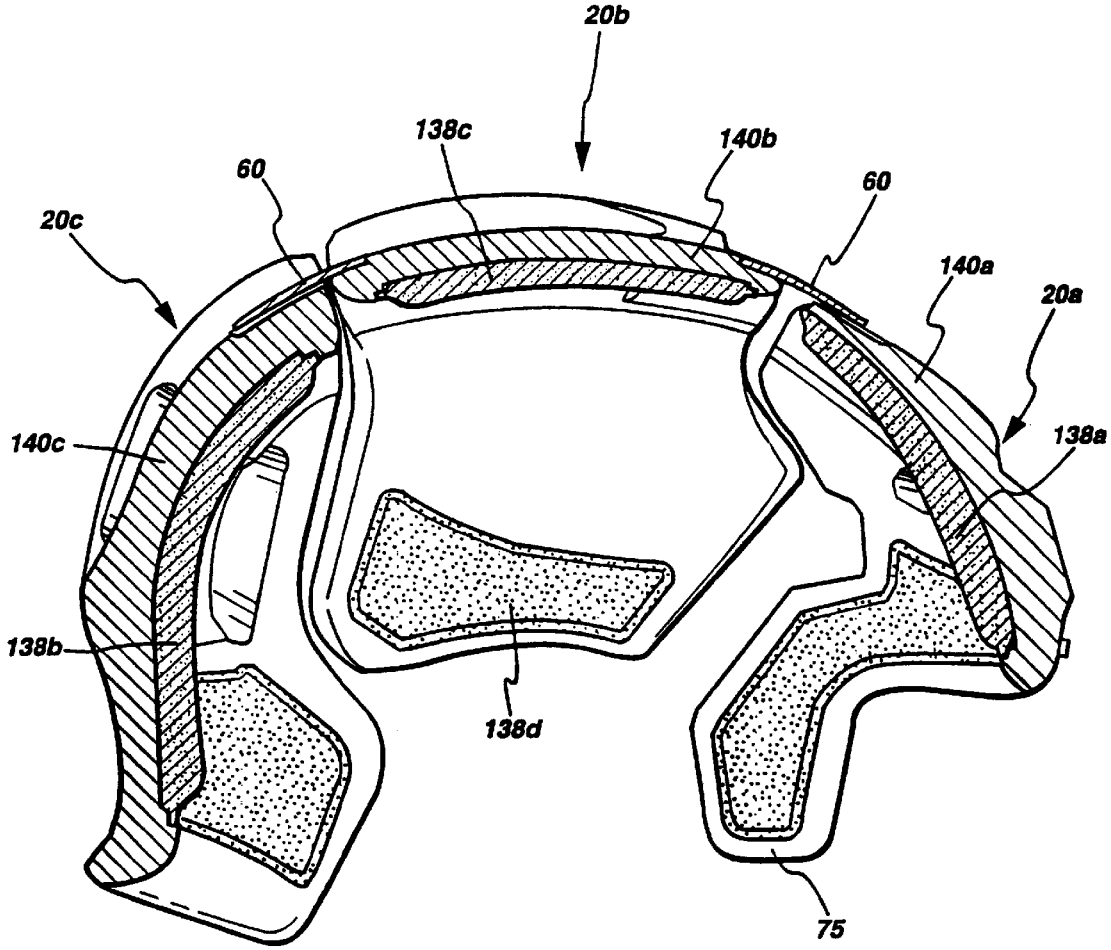
FIG. 8 is a cross-sectional view of the inner pad assembly according to a further embodiment of the invention.

In accordance with the present invention, centrally located intermediate pad 20*b* is slidably connected to pads 20*a* and 20*c* by means of interlocking tongue means and thus, intermediate pad assembly 20*b* is preferably not secured to the helmet shell. The tongue means 60 protrudes from both the front portion 42 and the rear portion 43 of intermediate pad assembly 20*b* and has a length sufficient to overlap a portion of the front pad assembly 20*a* and the back pad assembly 20*c* in a position intermediate at least a portion of the front pad assembly 20*a* and the helmet shell 10, and intermediate at least a portion of the back pad assembly 20*c* and the helmet shell 10. The front pad assembly 20*a* and the back pad assembly 20*c* thereby retain the intermediate pad assembly 20*b* within the helmet shell 10. Tongue means 60 is preferably planar, as illustrated in FIGS. 1, 3 and 7 having a major surface which is substantially parallel to the helmet shell contacting surface 21 of the intermediate pad assembly 20*b*. In a preferred embodiment, tongue means 60 forms the uppermost surface of intermediate pad assembly 20*b*. Alternatively, tongue means 60 may be substantially cylindrical and may comprise a plurality of protrusions emanating from the front portion 40 and the rear portion 43 of intermediate pad assembly 20*b*.

Tongue means 60 may be formed from any resilient material having sufficient rigidity, such that when tongue means 60 is slidably connected to front pad assembly 20*a* and rear pad assembly 20*c*, tongue means 60 securely retains intermediate pad assembly 20*b* in helmet shell 10. In a preferred embodiment, tongue means 60 is formed from a rigid plastic such as polystyrene, polypropylene, nylon, polycarbonate, and the like and combinations thereof. Tongue means 60 may be integrally formed with intermediate pad assembly 20*b* by conventional injection moulding techniques wherein tongue means 60 is placed in a suitably shaped mould and a foamed polymer is injected therein, the polymer is permitted to cure into a rigid structure, and the pad assembly is then removed from the pad mould. Alternatively, tongue means 60 may be fastened to intermediate pad assembly 20*b* by means of any conventional fastening systems such as screws, bolts, adhesives, and the like and combinations thereof.

The front pad assembly 20*a* is preferably provided with a channel 79 located on a top surface of said front pad assembly 20*a* having a shape which generally corresponds to tongue means 60. Alternatively, the channel 60 may be in the form of a slot (not shown) within the thickness of the front pad assembly whereby the tongue means 60 is inserted into said front pad assembly 20*a*. The back pad assembly is similarly provided with a channel 79 or slot as described above to slidably engage the tongue means 60 along a rear portion 43 of intermediate pad assembly. In this manner, the tongue means 60 is slidably secured to both the front pad assembly 20*a* and to the back pad assembly 20*c*.

The pad assemblies 20*a*, 20*b* and 20*c* of the present invention may be formed from any resilient, mouldable, shock absorbing materials such as a foamed styrene polymer, a foamed urethane polymer or other rigid foam-like material being light in weight and having shock absorbing properties. Each pad assembly may have its outer surfaces treated to provide washable surfaces of the pads, for example, by dipping the pads in a suitable material such as liquid vinyl, urethane or latex. In addition, each pad assembly may have a densified outer layer defining either the front surface 22, the back surface 21 or both the front and back surfaces. The process of densifying a pad assembly is more fully disclosed in U.S. Pat. No. 4,282,610 which is incorporated herein in its entirety.

Referring to FIG. 5, when assembling the protective helmet of the present invention, a front pad assembly 20*a* is placed in a forward position in helmet shell 10, wherein the fastener 30*b* is aligned with a mounting hole (not shown) in the helmet shell 10, and is secured in place by means of securement means (not shown). Similarly, back pad assembly 20*c* is placed in a rearward position in helmet shell 10, wherein the fastener 30*a* is aligned with a mounting hole (not shown) in the helmet shell 10, and is secured in place by means of securement means (not shown). As shown in FIG. 6, intermediate pad assembly is placed between the front pad assembly 20*a* and the back assembly 20*c* and slidably retained within the helmet shell by tongue means 60.

According to a further embodiment of the present invention, each of the inner pad assembly 20*a*, 20*b* and 20*c* comprises a first moulded inner liner 140*a*, 140*b* and 140*c* that is made from a generally rigid light weight foam-like material and also comprises second generally soft liners 138*a* to 138*e* that are secured to the inside of the first liners 140*a*, 140*b* and 140*c*. As shown more particularly in FIG. 4, soft liners are preferably located at the front portion 138*a*, the rear portion 138*b*, the top portion 138*c* and the sides 138*d*.

The first moulded inner liners 140*a*, 140*b* or 140*c* may be formed from any resilient preferably mouldable, shock absorbing materials such as a foamed styrene polymer, a foamed urethane polymer or other rigid foam-like material being light in weight and having shock absorbing properties. Each pad assembly may have its outer surfaces treated to provide washable surfaces of the pads, for example, by dipping the pads in a suitable material such as liquid vinyl, urethane or latex.

A preferred material for the first moulded inner liner 140*a*, 140*b* or 140*c* consists of an expanded polypropylene (EPP) having a density ranging preferably from about 2.75 to about 5.25 pounds per cubic feet (pcf), and ranging most preferably from about 3.5 to abut 4.5 pcf. In general, the thickness of the first inner liner is approximately ½ inch although it may vary according to the needs.

Apart from its ability to absorb and dissipate high amounts of energy, the use of EPP also has the advantage of being light weight in comparison with the foam or foam-like liners of the prior art which have a density in the area of 7 pcf.

A preferred material for the second generally soft inner liners 138*a* to 138*e* consists of a synthetic thermoplastic polymer such as polyvinyl chloride (PVC). A most preferred material is an expanded padding having a thickness of approximately 7.5+–0.5 mm and having a density ranging preferably from about 12 to about 18 pcf and most preferably from about 14 to about 16 pcf. Such a product is sold under the name CRESPADORO 143/96. The PVC liner has the advantage of being washable and of being non absorbent. The second liners 138*a* to 138*e* are attached to the inside of the first liner in any suitable manner. Preferably, they are glued but they could also be mechanically attached via velcro type fasteners.

During use, the second soft liner will readily compress and will provide for proper fitting of the helmet on the player's head while absorbing smaller amounts of energy, the higher amounts of energy being dissipated by the first liner 140*a*, 140*b* or 140*c*.

The liner of the helmet according to this embodiment of the present invention thus comprises a front pad assembly 20*a*, an intermediate pad assembly 20*b* and a rear pad assembly 20*c*, each of which comprises a first moulded liner 140*a*, 140*b* and 140*c*, and a second soft liner 138*a* to 138*e*. This combination brings about substantial advantages over the liners and helmets of the prior art in terms of performance and certification.

As previously mentioned, the standards that must be met by hockey helmets have been set forth by the canadian Standards Association, in their standards for Hockey Helmets, under publications No. Z262.1-1975 and No. CAN/CSA-Z262.2-M.90, the content of which is incorporated herein by reference. According to the procedure outlined in that standard, the structural integrity of the helmet is determined by submitting it to various impacts at different sites such as the rear, side, crown, rear boss, front boss and front portions. By reason of its inherent geometry, a hockey helmet will generally have a relatively flat side and accordingly, more force will be transmitted to the head in this area upon impact. Since the side area of the helmet is the weakest point, helmet manufacturers will usually adjust their liner to a thickness and density such that it will meet the standard at that impact area. This determination will therefore affect the entire liner and the entire helmet. This results in a helmet that is always heavier than actually required since excess liner is used in areas where it is not required.

Contrary to this, the liner of the present invention may be customized to take into consideration the weakest points and the geometry of the helmet. Therefore, by having a liner that is separated into distinct parts that cover various areas of the head, the inventors are capable of manufacturing a very light helmet. For example, the density of the liner that is intended to cover the side area of the head (the weakest point of the helmet) may be kept higher and therefore more absorbing while the density of the liner in other areas may be kept lower, thereby providing a lighter helmet. For example, in the case of the preferred embodiment described herein, the inventors have achieved very good performances by providing a liner in which the first moulded liner 140*b* has a density of approximately 4.25 to 4.5 pcf while the first moulded liners 140*a* and 140*c* have a density of approximately 3.5 pcf, the density of the soft liners 138*a* to 138*e* remaining constant at approximately 15 to 16 pcf.

The person skilled in the art will realize that the concept of the present invention could be expanded and that the density of the second soft liner could also be modified, provided comfort is not unduly sacrificed and provided that the standards are met. In fact, the liner of the present invention is very well adapted to respond to any changes in certification requirements. Similarly, while the preferred embodiment has been described using the pad assemblies 20*a*, 20*b* and 20*c*, it is understood that the invention is not so limited and the numbers of parts may vary keeping in mind however that more parts will most likely result in a higher manufacturing cost.

As is well known, it is important to provide free space within the interior of a protective helmet to permit evaporation of perspiration. As illustrated in FIGS. 1 to 4, each pad assembly is provided with one or more ventilation apertures or channels 78, 48 and 88, which are generally aligned with the ventilation apertures 18 in the helmet shell 10 to permit airflow in and out of the protective helmet, to promote cooling and to carry off warm moist air from within the protective helmet to the outside. Accordingly, the front pad assembly 20*a* is provided with ventilation apertures 78, the rear pad assembly 20*c* is provided with ventilation apertures 88, and the intermediate pad assembly 20*b* is provided with ventilation channels 48. It is preferred that the ventilation apertures 78 in the front pad assembly 20*a*, the ventilation channels 48 in the intermediate pad assembly 20*b* and the ventilation apertures 88 in the rear pad assembly 20*c* be substantially aligned longitudinally, i.e. from a front portion of the protective helmet, beginning at ventilation apertures 78 adjacent a front portion of the helmet shell 10, continuing through each respective pad assembly, and terminating at the ventilation apertures 88 adjacent a back portion of the helmet shell 10, to promote the movement of air through the helmet with movement of the wearer. This movement of the air is also facilitated by the presence of recessed areas 160, 162 and 164 which form a continuous channel from front to rear. Since the helmet is held comfortably in place through the second soft liners 138*a* to 138*e*, the head of the wearer does not obstruct the continuous channels formed by recessed areas 160, 162 and 164, unlike the helmets of the prior art that use a foam or foam-like padding that fit snugly against the head. Ventilation is thus greatly improved.

With respect to the above description, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

What is claimed is:

1. A protective helmet comprising a pad assembly and a protective helmet shell, said protective helmet shell having a front portion and a back portion, said pad assembly being formed of shock-absorbing material and comprising a front pad assembly secured to said front portion, a back pad assembly secured to said back portion, an unsecured intermediate pad assembly centrally positioned between said front pad assembly and said back pad assembly, and means for slidably connecting said intermediate pad assembly to said front pad assembly and to said back pad assembly.

2. The protective helmet as defined in claim 1, wherein said helmet shell has a ventilation aperture and wherein at least one of said front pad assembly, said rear pad assembly, and said intermediate pad assembly has a ventilation channel cooperating with said ventilation aperture of said helmet shell to allow air to circulate within said helmet shell.

3. The protective helmet as defined in claim 1 wherein said intermediate pad assembly comprises an interlocking tongue and wherein said intermediate pad assembly is slidably connected to said front pad assembly and to said back pad assembly by said interlocking tongue.

4. The protective helmet as defined in claim 3 wherein said interlocking tongue is planar.

5. The protective helmet as defined in claim 4 wherein said interlocking tongue extends from both ends of said intermediate pad assembly.

6. The protective helmet as defined in claim 5 wherein said front pad assembly and said back pad assembly each comprises a channel and wherein said interlocking tongue is adapted to be inserted into said channel.

7. The protective helmet as defined in claim 6 wherein said intermediate pad assembly has a tapered front portion creating a recessed area adapted to permit an overlap between said intermediate pad assembly and said front pad assembly.

8. The protective helmet as defined in claim 7 wherein said front pad assembly, said rear pad assembly, and said intermediate pad assembly each have a soft liner and wherein the density of the liner is higher in said intermediate pad assembly than in said front and rear pad assembly.

9. A pad assembly for use in a protective helmet shell, said pad assembly being formed of shock-absorbing material and comprising a front pad assembly, a back pad assembly, an intermediate pad assembly centrally positioned between said front pad assembly and said back pad assembly, and an interlocking tongue, said intermediate pad assembly being slidably connected to said front pad assembly and to said back pad assembly by said interlocking tongue, wherein said intermediate pad assembly has a front portion and a rear portion, and said interlocking tongue protrudes from both said front portion and said rear portion of said intermediate pad assembly and has a length sufficient to partially overlap said front pad assembly and said back pad assembly.

10. The pad assembly for use in a protective helmet shell as defined in claim 9, wherein said intermediate pad assembly has a tapered front portion creating a recessed area adapted to permit an overlap between said intermediate pad assembly and said front pad assembly.

11. The pad assembly for use in a protective helmet shell as defined in claim 9, wherein said intermediate pad assembly has a tapered rear portion creating a recessed area adapted to permit an overlap between said intermediate pad assembly and said rear pad assembly.

12. The pad assembly for use in a protective helmet shell as defined in claim 9, wherein at least one of said front pad assembly, said back pad assembly, and said intermediate pad assembly has a soft liner.

13. The pad assembly for use in a protective helmet shell as defined in claim 12, wherein said front pad assembly, said rear pad assembly, and said intermediate pad assembly each have a soft liner and wherein the density of the liner is higher in said intermediate pad assembly than in said front and rear pad assembly.

14. A protective helmet comprising:

an outer rigid helmet shell having a front portion, a back portion and an inner surface and being shaped to protect top, rear, front and side regions of the head of a wearer; and a pad assembly disposed in said helmet shell, said pad assembly being formed of a shock-absorbing material and having a front pad assembly secured to said front portion, a back pad assembly secured to said back portion, and a loose intermediate pad assembly centrally positioned between said front pad assembly and said back pad assembly, and wherein said intermediate pad assembly is slidably connected to said front pad assembly and to said back pad assembly.

15. The protective helmet as defined in claim 14, wherein said front, intermediate, and back pad assemblies cover substantially the entire surface of said helmet shell.

16. The protective helmet as defined in claim 14 wherein said intermediate pad assembly comprises an interlocking tongue and wherein said intermediate pad assembly is slidably connected to said front pad assembly and said to back pad assembly by said interlocking tongue.

17. The protective helmet as defined in claim 16, wherein said intermediate pad assembly has a front portion and a rear portion, and said interlocking tongue protrudes from both said front portion and said rear portion of said intermediate pad assembly and has a length sufficient to partially overlap said front pad assembly and said back pad assembly.

18. The protective helmet as defined in claim 17 wherein said interlocking tongue is planar.

19. The protective helmet as defined in claim 18 wherein said interlocking tongue extends from both ends of said intermediate pad assembly.

20. The protective helmet as defined in claim 19 wherein said front and back pad assembly each comprises a channel and wherein said interlocking tongue is adapted to be inserted into said channel.

21. The protective helmet as defined in claim 20 wherein said intermediate pad assembly has a tapered front portion creating a recessed area adapted to permit an overlap between said intermediate pad assembly and said front pad assembly.

22. The protective helmet as defined in claim 21 wherein said front pad assembly, said rear pad assembly, and said intermediate pad assembly each have a soft liner and wherein the density of the liner is higher in said intermediate pad assembly than in said front and rear pad assembly.

23. A protective helmet comprising an outer rigid helmet shell having a front portion, a back portion, and an inner surface and being shaped to protect top, rear, front, and side regions of the head of a wearer; and a pad assembly disposed in said helmet shell, said pad assembly being formed of a shock-absorbing material and having a front pad assembly, a back pad assembly, an intermediate pad assembly centrally positioned between said front pad assembly and said back pad assembly, and an interlocking tongue and wherein said intermediate pad assembly is slidably connected to said front pad assembly and to said back pad assembly by said interlocking tongue.

* * * * *